United States Patent [19]

Nilson et al.

[11] Patent Number: 4,485,656

[45] Date of Patent: Dec. 4, 1984

[54] TRANSMISSION PISTON AND METHOD OF MAKING THE SAME

[75] Inventors: Carl A. Nilson; Thomas J. Weir, both of Jackson, Mich.

[73] Assignee: Hayes Albion Corporation, Jackson, Mich.

[21] Appl. No.: 412,282

[22] Filed: Aug. 27, 1982

[51] Int. Cl.[3] ..... B21H 1/00

[52] U.S. Cl. ..... 72/84; 29/156.5 R

[58] Field of Search ..... 92/172, 192, 208; 29/156.5 R, 159 R; 72/68, 84, 105, 106, 110, 107, 109

[56] References Cited

U.S. PATENT DOCUMENTS

| | | | |
|---|---|---|---|
| 975,301 | 11/1910 | Talbot | 92/208 |
| 1,854,455 | 4/1932 | Day | 29/156.5 R |
| 3,712,099 | 1/1973 | Elsbett et al. | 29/156.5 R |
| 4,193,179 | 3/1980 | Confer et al. | 92/208 |

FOREIGN PATENT DOCUMENTS

| | | | |
|---|---|---|---|
| 701881 | 1/1941 | Fed. Rep. of Germany | 29/156.5 R |
| 59546 | 5/1981 | Japan | 29/159 R |
| 88927 | 6/1982 | Japan | 29/156.5 A |

OTHER PUBLICATIONS

Hayes-Albion Corporation Sketches of Design-Exhibits A and B.

*Primary Examiner*—Lowell A. Larson

*Attorney, Agent, or Firm*—Beaman & Beaman

[57] ABSTRACT

The invention pertains to a piston for use in vehicle automatic transmissions and the method of making the same. An automatic transmission piston is of an annular configuration having a radial pressure face and an axially extending flange which includes an outer periphery in which a seal receiving groove is defined. The invention produces the piston from a sheet metal stamping blank and the blank flange is of a greater axial dimension than that of the flange after forming. The seal receiving groove is formed in the piston flange by a rolling operation, and during the rolling the axial dimension of the flange is reduced by compression of the flange material wherein the metal radially displaced is provided by the flange compression and the radial dimension of the flange thickness is substantially maintained during and after rolling as the simultaneous compression of the flange during the rolling of the seal receiving groove provides the extra metal required without producing a deficiency in the piston dimensions.

2 Claims, 4 Drawing Figures

TRANSMISSION PISTON AND METHOD OF MAKING THE SAME

BACKGROUND OF THE INVENTION

Vehicle automatic transmissions include a plurality of annular pistons acted upon by fluid pressure to produce the desired sequence of gear selection during the transmission operation. In the past, automatic transmission pistons are usually formed as die castings or as multiple piece stampings wherein the components are welded or otherwise assembled.

Pistons formed by die casting may be accurately constructed, but the cost is high and porosity problems are often encountered. Automatic transmission pistons constructed from a plurality of stamped sheet metal components may take a variety of configurations, but this mode of construction is also troublesome in that the stamped components must be very accurately assembled and welded together and problems of reliability and cost exists.

It is an object of the invention to provide a piston for vehicle automatic transmissions which is of a simple one piece stamped sheet metal construction which may be economically and accurately fabricated, and is reliable in operation.

A further object of the invention is to provide an automatic transmission piston of stamped construction wherein a seal receiving groove is rolled within the piston flange, and yet, reduced radial wall thickness of the flange is avoided.

A further object of the invention is to provide a method for forming a one piece stamped sheet metal automatic transmission piston having a peripheral seal receiving groove defined within a piston flange wherein the flange configuration is formed by rolling without a significant reduction in the radial thickness of the flange occurring.

An additional object of the invention is to provide a method for forming an automatic transmission piston of one piece sheet metal stamped construction wherein the piston includes a flange having a rolled seal receiving groove defined therein and wherein metal radially displaced during the rolling is provided by the flow of flange material produced by axially compressing the flange during rolling.

In the practice of the invention a cup-shaped annular sheet metal blank is formed by a stamping process. The blank includes a radially extending pressure face and an axially extending flange of cylindrical configuration. The axial length of the flange blank is greater than the flange axial length desired in the finished piston.

The piston blank is placed within a fixture capable of rotating about an axis coinciding with the piston axis. The fixture radially supports the piston flange inner surface. A mating fixture, also capable of rotating about an axis coinciding with the piston axis, is capable of moving parallel to the piston axis so as to apply force upon the piston flange for its entire circumference. At least one roller die and slide is mounted adjacent to the retained blank, having an axis of rotation parallel to the piston and fixtures. The roller die is mounted on a slide capable of moving radially with respect to the axis of rotation of the piston and fixtures. The roller peripheral shape corresponds to the form to be rolled into the piston flange to produce the seal receiving groove and flange configuration desired.

As the piston blank is of a greater initial axial dimension than desired in the finished product the flange is axially compressed by the associated fixture simultaneously during the flange rolling. The metal radially displaced outwardly due to the rolling is primarily supplied by the metal flow resulting from the flange axial length reduction, and accordingly, during flange rolling, and in the finished product, the minimum radial thickness of the flange continuously substantially corresponds to the original flange radial thickness avoiding thinning and attendant localized stress. Preferably, the metal displaced during the rolling of the flange is supplied at a rate substantially equal to the rate that metal is available due to the axial length reduction of the flange and the simultaneous axial and radial flow of metal within the flange produces a homogeneous flange construction having smooth uninterrupted metal flow contours relatively free of stress resulting in a high strength automatic transmission piston of high reliability at reduced cost.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
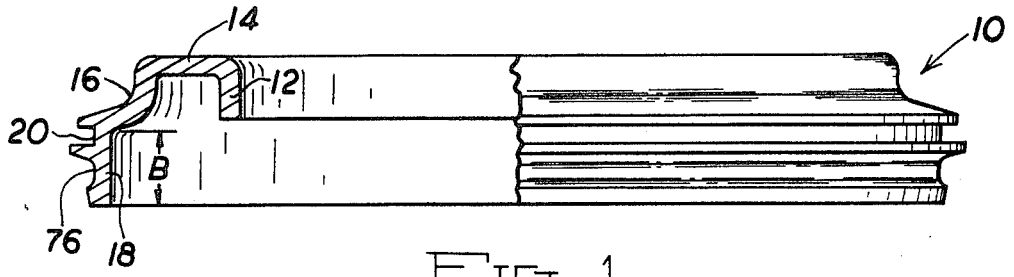
FIG. 1 is an elevational view, the left half thereof being shown in the diametrical elevational section, of an automatic transmission piston in accord with the invention.

While the details of configurations of automatic transmission pistons may vary depending upon the particular purpose of the piston, the manufacturer, and the model of transmission in which utilized, a basic configuration of such pistons is shown in FIG. 1, and the inventive concepts can be utilized in the manufacture of most automatic transmission pistons of the general type illustrated. As will be appreciated from FIG. 1, a typical piston 10 in accord with the invention is of an annular form and includes an inner axially extending hub 12, a radially extending pressure face portion 14, a transition portion 16, and an axially extending flange 18 having an outer surface which defines the piston periphery, and an annular seal receiving groove 20 is defined upon the flange outer surface. For reliability and strength it is desired that the piston thickness be substantially uniform at all locations, and while the radial thickness at the groove 20 may be slightly less than at other locations, the thickness of the flange at the groove is not significantly less than the thickness at other portions of the piston and the piston is relatively free of localized stress points for reliability and resistance to fracture.

Figure 2:
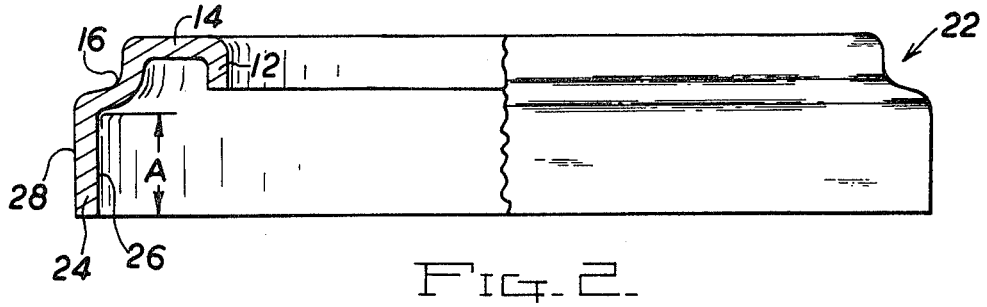
FIG. 2 is an elevational view of the sheet metal blank used in the formation of a piston in accord with the invention, the left half being shown in elevational sectional diametrical section.

In accord with the invention the automatic transmission piston 10 is formed in one piece from sheet metal, such as aluminum or steel by a stamping process utilizing a stamped blank 22. The formed blank is shown in FIG. 2 and the hub 12 and pressure face portion 14 are substantially formed in the final configuration during the blank forming process. The blank transition portion 16 supports the blank flange 24 which is of a cylindrical configuration having an inner surface 26 and an outer surface 28. The axial dimension of the blank flange is represented by the dimension A in FIG. 2, and in FIG. 1 the flange axial dimension is represented by dimension B. As readily appreciated from the drawings the blank flange axial dimension A is greater than the flange dimension B of the formed piston. The extent of the differences between dimensions A and B will vary in accord with the thickness of the blank sheet metal, the configuration to be rolled upon the flange, the characteristics of the metal of the blank, and similar factors commensurate with the inventive concepts as set forth below.

Figure 3:
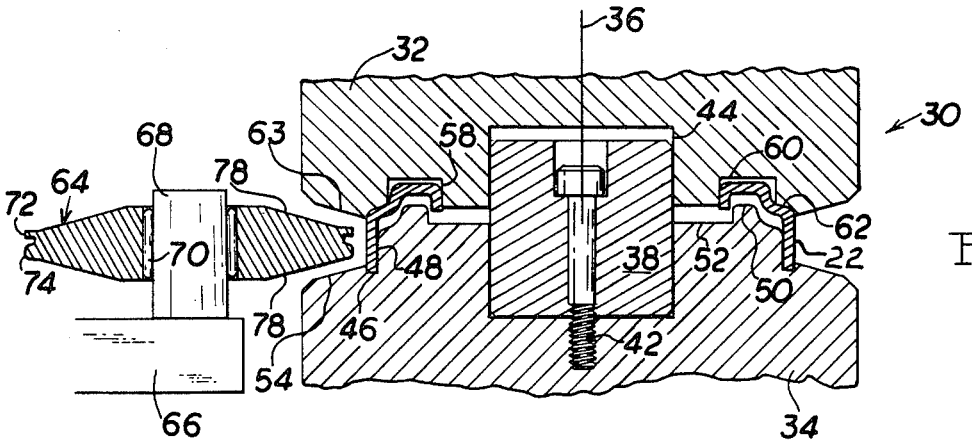
FIG. 3 is an elevational, sectional view of the die and roller apparatus used in the formation of the piston prior to the compression and rolling of the piston blank.
Figure 4:
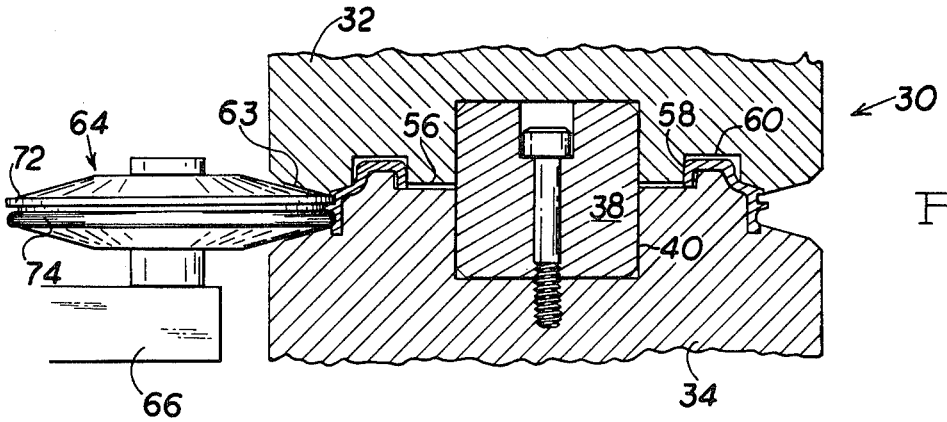
FIG. 4 is a view similar to FIG. 3, the roller being shown in elevation, at the termination of the piston formation process, the dies being closed, and the roller completing the flange configuration.

Processing of the sheet metal piston blank of FIG. 2 to the finished form of FIG. 1 is accomplished by the apparatus illustrated in FIGS. 3 and 4. The piston blank 22 is placed within a rotating press or fixture 30 which consists of an upper half 32, and a lower half 34 relatively movable toward each other. Usually, the lower half 34 will be stationary, and the upper half 32 will be mounted upon a hydraulic ram or other power source capable of exerting a high compressive force toward the fixture half 34. The die halves are mounted upon bearings, not shown, and one or the other is power driven to simultaneously rotate about a central vertical axis as represented at 36, FIG. 3. A guide block 38 is affixed to the lower die half 34 and is received within recess 40 and maintained therein by the bolt 42. The upper die half 32 includes a complimentary recess 44 for receiving the guide block 38 as the die halves approach each other and the guide block will maintain the alignment of the die halves during piston formation.

The lower die half 34 includes an annular recess 46 concentric to the axis 36 for closely receiving the free end of the piston blank flange 24, FIG. 2. Further, the die half includes an adjacent cylindrical axial surface 48, an annular ridge 50, and the radial flat surface 52 adjacent guide block 38. Adjacent its periphery, the die half 34 is recessed by oblique surface 54 to provide roller clearance.

The upper die half 32 includes a radial surface 56 intersecting axial shoulder 58 which engages the blank hub 12. Half 32 is recessed at 60, to provide clearance for the pressure face portion 14, and an oblique contoured surface 62 engages the blank transition portion 16 in axial alignment with the flange 24. The die half 32 is recessed at surface 63 to provide roller clearance.

One or more forming rollers 64 are mounted about the circumference of the die 30, one of these rollers being shown in FIGS. 3 and 4. The rollers 64 are mounted upon a support slide 66 capable of being moved in a horizontal direction toward and away from the axis 36. The slide 66 includes an upstanding journal 68 upon which the roller 64 is mounted by anti-friction roller bearings 70. The periphery of the rollers 64 includes a projection 72 which forms the piston oil seal groove 20, and projection 74 is axially displaced therefrom to form the piston flange recess represented at 76 in FIG. 1. It will be appreciated that the lateral surfaces 78 of the roller converge toward each other in a direction outwardly from the roller axis.

Initially, the die halves 32 and 34 will be sufficiently parted by raising the half 32 wherein guide block 38 will be out of engagement with the recess 44, and the piston blank 22 as shown in FIG. 2 may be placed upon the lower die half 34 in the relationship shown in FIG. 3 wherein the free end of the flange 24 is received within annular recess 46, and the flange inner surface 26 will be engaged by the axial surface 48. Thereupon, the upper die half 32 will be lowered to the relationship shown in FIG. 3 wherein the alignment between the die halves is maintained by guide block 38 and recess 44, and the contoured surface 62 will engage the transition portion 16 in axial alignment with the flange.

The die 30 is now rotated about the axis 36, and the rollers 64 are moved radially inwardly to engage the outer surface 28 of the flange. Access to the flange outer surface by the forming rollers is assured by the roller clearance surfaces 54 and 63.

As the forming rollers 64 are brought into engagement with the outer surface of the flange 24 the die halves 32 and 34 are closed in an axial direction to shorten the flange 24. Such axial length reduction of the flange will produce a metal flow tending to cause the flange radial dimension to increase, but this "surplus" flange material is utilized in the radial deformation of the flange material caused by the rollers 64. As the rollers move inwardly the flange material "extrudes" outwardly in confirmation to the roller contour, and the rollers continue to move inwardly until the desired diametrical dimension of the seal groove 20 and the outer surface of the piston flange 18 is achieved. Of course, during the entire rolling operation the flange is retained against inward deformation by the axial die surface 48 which supports the flange throughout its rolled dimension.

Preferably, the rate of length reduction of the piston blank flange 24 is correlated to the rate of inward movement of the rollers 64 and the configuration of the rollers wherein the "extra" material required within the flange to accommodate the outward metal flow due to the rolling is supplied by the flange axial compression. Thus, at no time during the rolling of the piston flange is the flange subjected to excessive "thinning" and stresses within the flange are minimized.

Upon the "closing" of the die halves 32 and 34 being completed, and upon the radial inward movement of the rollers 64 terminating, the correct axial and radial dimension of the piston flange 18 will have been achieved, and the rollers are retracted, and the die halves raised to permit the formed piston 10 to be removed from the die halves by release pins, not shown. The piston will be accurately sized by the aforedescribed process, and little machining and deburring, if any, is required.

It will be appreciated that the aforedescribed method of forming an automatic transmission piston permits a one piece piston to be formed from an economically produced sheet metal stamping. The seal receiving groove 20 is homogeneously defined in the piston flange, secondary operations after formation are minimized, and as a substantially constant flange radial dimension is maintained throughout the formation and in the end product weaknesses in the piston due to metal working and other stressing is minimized. The simultaneous axial compression and flow of metal within the flange during the flange rolling produces an advantageous flow of metal throughout the flange configuration resulting in a high strength at the groove ridges and excellent physical characteristics are achieved which are attributed to the simultaneous flange compression and rolling.

It is appreciated that various modifications to the inventive concepts may be apparent to those skilled in the art without departing from the spirit and scope of the invention.

We claim:

1. The method of forming a piston for an automatic transmission of sheet metal wherein the piston is of an annular configuration having an axis, a radial pressure face and an axially extending flange defining the piston periphery having an outer surface which includes an annular seal receiving groove comprising the steps:

(a) forming an annular sheet metal stamping having an axis, an annular radial pressure face portion and an axially extending cylindrical flange projecting from said pressure face portion having an inner surface and an outer surface defining the periphery of said stamping, (b) rotating said stamping about its axis while radially supporting the flange inner surface, and (c) simultaneously compressing the stamping flange in an axial direction while engaging the flange outer surface with a forming roller to produce radially outward deformation of the flange material to form the seal receiving groove whereby the flange axial compression provides the primary material required for radial deformation and the radial dimension of the flange remains substantially constant.

2. The method of forming a piston for an automatic transmission as in claim 1 wherein the compression of the flange in an axial direction substantially occurs at the rate required to supply the flange material radially displaced by rolling.

* * * * *